US007762898B2

(12) United States Patent
Lunde et al.

(10) Patent No.: US 7,762,898 B2
(45) Date of Patent: Jul. 27, 2010

(54) AMUSEMENT SLIDE WITH LIGHTING EFFECT

(75) Inventors: Montgomery C. Lunde, Santa Clarita, CA (US); Clement Folckemer, South Pasadena, CA (US)

(73) Assignee: Technifex Products, LLC, Valencia, CA (US)

( * ) Notice: Subject to any disclaimer, the term of this patent is extended or adjusted under 35 U.S.C. 154(b) by 241 days.

(21) Appl. No.: 11/923,296

(22) Filed: Oct. 24, 2007

(65) Prior Publication Data

US 2009/0111592 A1 Apr. 30, 2009

(51) Int. Cl.
*A63G 21/00* (2006.01)
*A63G 21/18* (2006.01)

(52) U.S. Cl. ..... 472/116; 472/61; 472/117

(58) Field of Classification Search ..... 472/116, 472/117, 128, 58–74; 446/175, 219; 362/84
See application file for complete search history.

(56) References Cited

U.S. PATENT DOCUMENTS 5,482,510 A 1/1996 Ishii et al.
6,095,927 A * 8/2000 Malone ..... 472/62
6,488,590 B2 12/2002 Katayama
6,962,534 B2 * 11/2005 Richter et al. ..... 472/90

FOREIGN PATENT DOCUMENTS

JP 05-035185 U 5/1993
JP 07-265547 A 10/1995
JP 10-211362 A 8/1998
KR 20-1997-60793 U 12/1997

* cited by examiner

*Primary Examiner*—Kien T Nguyen
(74) *Attorney, Agent, or Firm*—Christopher J. Kulish

(57) ABSTRACT

The invention is directed to a slide with at least a portion of the slide being covered so as to define a tunnel in which a user of the slide is likely to having difficulty seeing where the slide is taking them and a lighting effect that uses invisible light (e.g., ultraviolet light, black light, or infrared light) and an element that, in response to invisible light, produces visible light in the tunnel that is capable of being seen by a user that is passing through the tunnel. Also provided is a method for retrofitting an existing amusement slide that has a tunnel without such a lighting effect or that has a tunnel with inadequate or undesirable lighting effect.

17 Claims, 7 Drawing Sheets

AMUSEMENT SLIDE WITH LIGHTING EFFECT

FIELD OF THE INVENTION

The present invention relates to an amusement slide and, more specifically, to a slide with at least a portion of the slide covered and a lighting effect that provides visible light to a user that is passing through the covered portion of the slide.

BACKGROUND OF THE INVENTION

There are several types of amusement slides. However, all amusement slides have a slide that is comprised of one or more pieces of material that form a path that extends from a first end to a second end and over which an individual can travel. The first end of the slide is where a user enters the slide and the second end is where a user exits the slide. Typically, the slide has lateral cross-section with a U-shape that serves to keep the user on the slide and traveling between the first and second ends. In many instances, the first end is at a higher elevation than the second end so that gravity provides at least some of the force required to move a user between the first and second ends of the slide. The slide can be made of many different types of material. For example, many types of slides are made of a material with a low coefficient of friction that allows a suitably clothed user to travel over the slide by having some portion of their clothing disposed between their body and the slide. An example of such a slide is the slide found on many playgrounds and backyards that is made of a polished aluminum or fiberglass. However, other types of slides are made of other materials that require a user to have some kind of apparatus disposed between them and the slide. For example, in many alpine slides, a portion of the slide is made of concrete and the user traverses the slide with the aid of a shuttle that is disposed between them and the slide. A water slide, another type of amusement slide, enhances the sliding effect by having a stream of water also flow over the slide or over one or more portions of the slide. The stream of water can be used to supplement any gravitational force that is being applied to move the user along the slide. In addition, the stream of water can be used to facilitate a slide with an upward directed portion. In such a water slide, the stream of water is used to push a user over the upward tending portion of the slide.

Many amusement slides have a cover that extends over at least a portion of the slide such that a user traveling through the covered portion of the slide is immersed into a relatively dark or totally dark environment. The dark environment is used to enhance the "thrill" associated with riding the slide. However, a significant number of users have a tendency to become anxious when traveling through this dark environment and tend to "tense-up" or "fight" the slide and, in so doing, injure themselves. Typically, the injuries are muscle strains and sprains.

SUMMARY OF THE INVENTION

The invention is directed to an amusement slide that is comprised of: (a) a slide, (b) a cover that is located adjacent to at least a portion of the slide, (c) the covered portion of the slide and the cover define a tunnel with an exterior surface, an interior surface, and an interior space, with at least a portion of the interior space being relatively or totally dark, and (d) a lighting effect that utilizes invisible light (e.g., ultraviolet light, "black light", or infrared light) to produce visible light or a visible image within the interior space of the tunnel. The lighting effect is comprised of a lighting device for producing invisible light and reactive device that responds to invisible light by producing visible light, typically through the mechanisms of fluorescence or phosphorescence. Consequently, when the amusement slide is in operation, invisible light will be present in the tunnel but a user traveling through the tunnel will be substantially unaware of the presence of the invisible light. However, the reactive device will produce visible light, typically in the form of a visible image, that is capable of being seen by the user passing through the tunnel. The visible light, in one embodiment, being used to provide the user with a warning relating to an upcoming change in the direction of the slide.

In one embodiment, a hole extends between the exterior and interior surface of the tunnel such that light can pass through the hole and into the interior space. A lighting device for producing invisible light is located so that the invisible light produced by the device passes through at least a portion of the hole and into the tunnel. By locating the lighting device in this manner, the electrical lines that provide the electricity needed to operate the device can be located adjacent to the outside of the tunnel, rather than within the tunnel. The ability to locate the electrical lines adjacent to the outside of the tunnel can be advantageous, depending upon the type of amusement slide involved. For instance, in water slides, the ability to locate the electrical lines adjacent to the outside of the tunnel is likely to reduce the actions needed to adequately insulate the electrical lines from any water flowing within the tunnel. In a particular embodiment, at least a portion of the electricity needed to drive the lighting device is provided by a solar device that is capable of receiving sunlight and, in response to the received sunlight, producing an electrical current. In another embodiment, at least a portion of the electricity needed to drive the lighting device is provided by a battery. In yet another embodiment, both a solar device and battery are employed. In this embodiment, the battery provides current to the lighting device and the solar device provides current for recharging the battery. Yet a further embodiment utilizes electrical power provided by a grid or a generator, e.g., 110 V power.

Another embodiment of the amusement slide is capable of producing a dynamic lighting effect within the tunnel. In this embodiment, at least two lighting devices are provided, each capable of producing invisible light. The reactive device is typically comprised of a corresponding number of reactive elements, each producing visible light in response to invisible light. The lighting devices are positioned so that the invisible light produced by each of the devices is cast upon a corresponding one of the reactive elements. A controller is provided that is capable of modulating or sequencing the current provided to each of the lighting devices. The modulation or sequencing of the current provided to the lighting devices, in turn, causes the visible light produced by the reactive elements to be likewise modulated or sequenced. In one embodiment, the reactive elements are positioned along a line that extends down the tunnel. The controller is adapted to apply current to each of the lighting elements for non-overlapping periods of time and to do so in a sequence that corresponds to the order in which the reactive elements have been established along the line within the tunnel. In operation, the reactive elements produce visible light for a non-overlapping periods of time and to do so in order.

A further embodiment of the amusement slide utilizes a solar device to produce the electrical energy that is used to drive the lighting device, thereby reducing and potentially eliminating the need to use current provided by an electrical grid or conventional electrical generator. For example, in a water slide in which the lighting effect does not require the use of power from the grid, the costs associated with running electrical lines from the grid in and around the locations at which water is or might be present are eliminated. In one embodiment, a solar device and a battery are used in providing current to the lighting device. The solar device operates to convert sunlight into electrical current that is used to charge the battery. In turn, the battery provides current to the lighting device and does so at times when the solar device is producing little or no current, such as at night.

Also provided is a method for retrofitting an existing amusement slide that has a tunnel with a lighting effect for the tunnel. Initially, the tunnel of the amusement slide is located. After the tunnel portion has been located, a lighting effect that uses invisible light to produce visible light within the interior space defined by the tunnel is installed, with the lighting effect being comprised of a lighting device for producing invisible light and a reactive device that, in response to invisible light, produces visible light. The installation of the lighting effect can be accomplished without removing an portion of the tunnel from the remainder of the amusement slide (i.e., in situ) or by removing at least a portion of the tunnel from the remainder of the amusement slide. In the in-situ case, the installation comprises positioning the lighting device and the reactive device so that the reactive device receives invisible light produced by the lighting device and, in response to the invisible light, produces visible light within the interior space defined by the tunnel. In the other case, installation comprises removing at least a portion of the tunnel and substituting a replacement portion for the removed portion that is adapted to accommodate the lighting effect. Alternatively, the removed portion of the tunnel can be processed to adapt the removed portion to accommodate the lighting effect and then reinserted into the amusement device. In certain situations, the portion of the tunnel that is to be retrofitted is comprised of a top portion that is joined to a bottom portion and the lighting device is going to be positioned adjacent to the top portion. In such situations, the top portion is removed and either replaced with a new top portion or processed to accommodate the lighting effect. Since only the top portion is removed, the amusement slide in many cases remains operable.

DETAILED DESCRIPTION

The invention is directed to an amusement slide in which at least a portion of the slide is covered. The covered portion of the slide and the cover define a tunnel that, in turn, defines an interior space. At least a portion of the interior space is relatively dark, i.e., is of a darkness that would make it difficult for a normal individual entering the relatively dark space from a sunlight environment to discern spatial references given the amount of time that the individual is meant to spend within the tunnel, or totally dark. A lighting effect is provided that utilizes invisible light to produce visible light in a relatively or totally dark portion of the tunnel.

Figure 1:
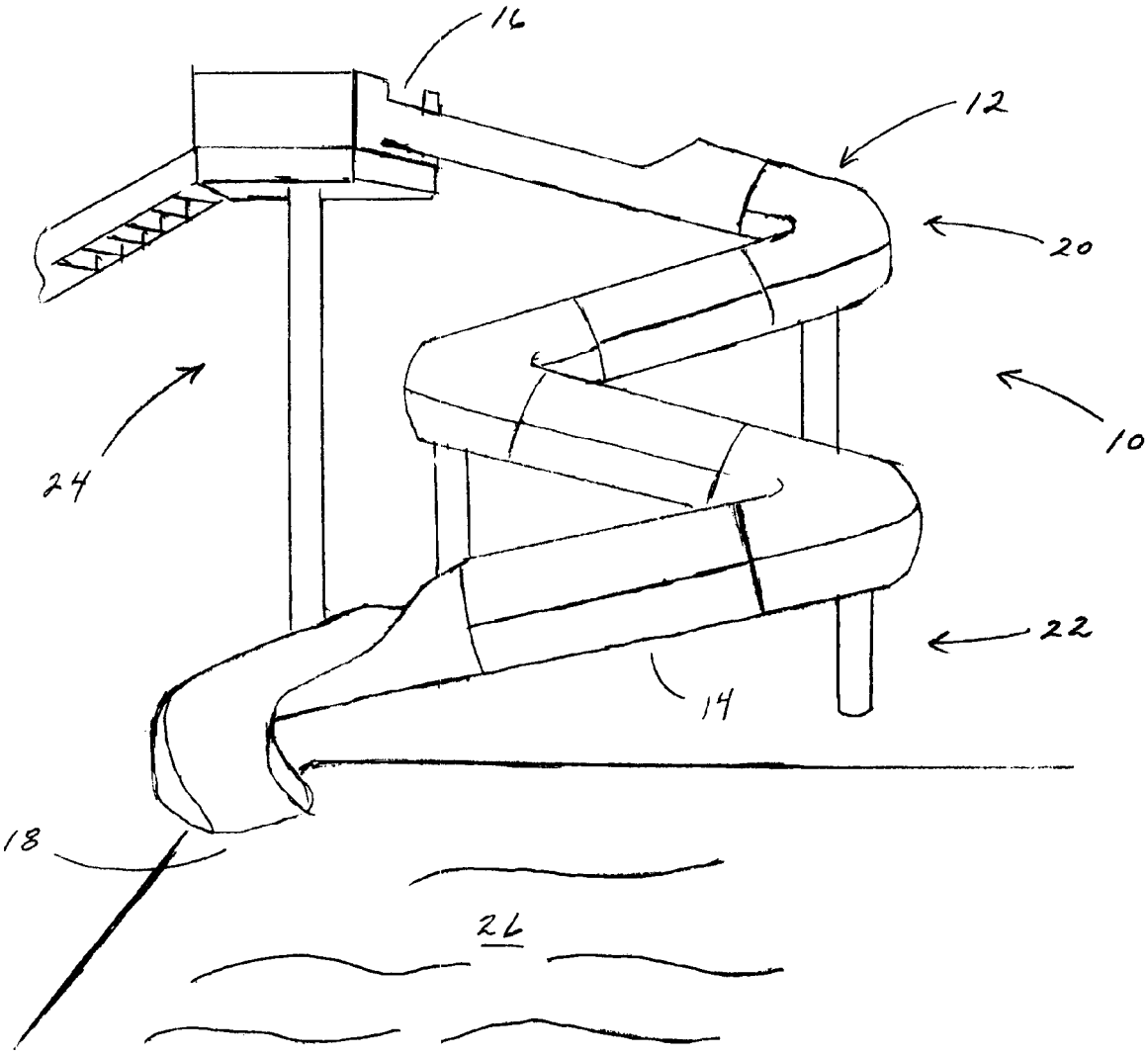
FIG. 1 illustrates an example of a water slide capable of being adapted to include a lighting effecting that utilizes invisible light to produce visible light within a tunnel portion of the water slide.

FIG. 1 illustrates an example of one type of amusement slide, namely, a water slide 10. The water slide 10 is comprised of a slide-cover structure 12. The slide-cover structure 12 includes a slide 14 that extends from a first end 16 at which a user enters the slide 14 to a second end 18 at which a user exits the slide. The slide-cover structure 12 also includes a cover 20 that covers at least a portion of the slide 14. The water slide 10 also includes a frame 22 for supporting the slide-cover structure 12. It should be appreciated that the extent of any frame that forms part of a water slide typically depends on the environment in which the water slide is built. For example, a water slide built on a hillside may have a substantially different frame than the frame 22. A stair and platform structure 24 provides users with access to the first end 16 of the slide 14. Other access structures (e.g., ramps, escalators, elevators etc.) are also feasible. The water slide 10 is located so that the second end 18 of the slide 14 is adjacent to a pool 26 or other body of water for receiving a user exiting the slide. A pump and piping system (not shown) provides water to one or more locations on the slide 14.

Figure 2:
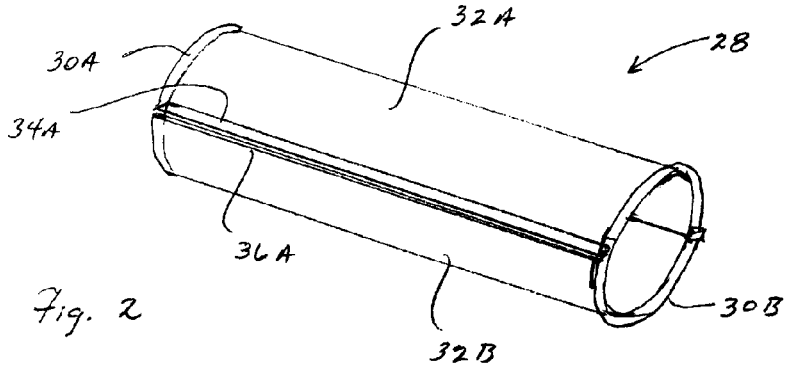
FIG. 2 illustrates a tunnel section of an embodiment of a water slide.

The slide-cover structure 12 is comprised of a number of tunnel sections. Each tunnel section is either straight, curved, or both straight and curved. Further, each tunnel section has at least one end flange for use in joining the tunnel section to an preceding or following portion of the slide-cover structure 12 using bolts, welding, or other suitable fastening technology. Several of the tunnel sections also include one or more mounts that facilitate the attachment of the tunnel section to a portion of the frame 22 via bolts, welding, or other suitable fastening technology. By way of example, FIG. 2 illustrates a straight tunnel section 28 with first and second end flanges 30A, 30B that each facilitate the attachment of the section 28 to an adjacent portion of the slide-cover structure 12. Each of the tunnel sections is also comprised of a top portion 32A and a bottom portion 32B. The top portion 32A includes flanges 34A, 34B, that are used in conjunction with flanges 36A, 36B, of the bottom portion 32B to attach the top portion 32A to the bottom portion 32B using bolts, welding, or other suitable fastening technology. Tunnel sections that are curved or both straight and curved also have top and bottom portions with flanges that are used in joining the top and bottom portions to one another and one or more end flanges. The illustrated tunnel sections have a circular cross-section. However, it should be appreciated that a tunnels with different cross-sectional shapes are feasible.

Figure 3A:
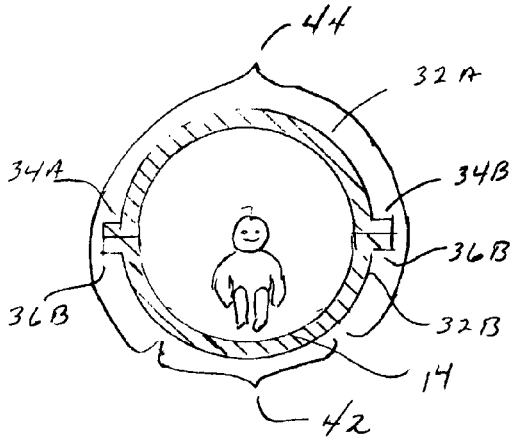
FIG. 3A is a cross-section of a straight tunnel section of an embodiment of a water slide that illustrates the circumferential extents of the slide and the cover in the straight tunnel section.
Figure 3B:
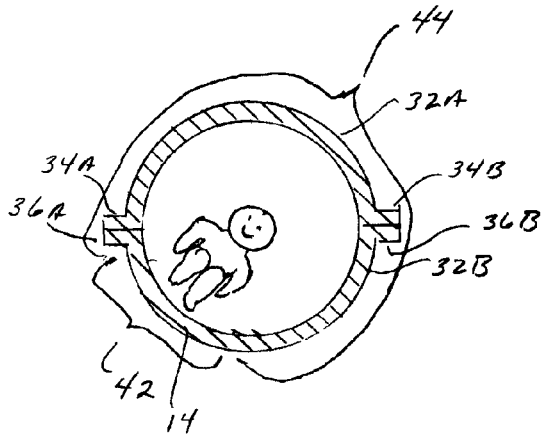
FIG. 3B is a cross-section of a curved tunnel section of an embodiment of a water slide that illustrates the circumferential extents of the slide and cover in the curved tunnel section.

Generally, the slide 14 is the area of the slide-cover structure 14 over which users travel when proceeding down the slide in a normal fashion and over which water generally travels. The slide 14 may also include a lateral area on each side of the area over which users travel. The area over which the user travels and the two lateral areas generally have a U-shaped or C-shaped or semi-circular, cross-section. FIG. 3A is a cross-section of a straight, tunnel section. In such a section, the slide 14 has a circumferential extent 42 that is defined by the area of the slide-cover structure 14 over which users travel and a circumferential area on each side of the area over which users travel. The cover 20 has a circumferential extent 44 that extends from the end-points of the circumferential extent 42 of the slide 14. In contrast, FIG. 3B is a cross-section of a curved, tunnel section. The circumferential extent 42 of the slide is different in the curved, tunnel section because a user would be traveling over a different area of the slide-cover structure 14 when passing through a curve than when traveling through a straight section. The circumferential extent 44 of the cover has also changed relative to the straight section. As can be appreciated by comparing FIGS. 3A and 3B, the circumferential extent 42 of the slide 14 changes position depending upon whether a user would be traveling through a straight section or a curved section. Relatedly, the circumferential extent 44 of the cover 20 also changes depending upon whether a user would be traveling through a straight section of a curved section. As should be appreciated, in various embodiments, the lateral extent of the slide at any point along the slide 14 may be: (a) limited to the bottom portion 32B of a section or (b) may include a part of the top portion 32A and part of the bottom portion 32A of a section. If a water slide has a slide that "corkscrews," the lateral extent of the of the slide may also be limited to the top portion of a section.

Figure 4:
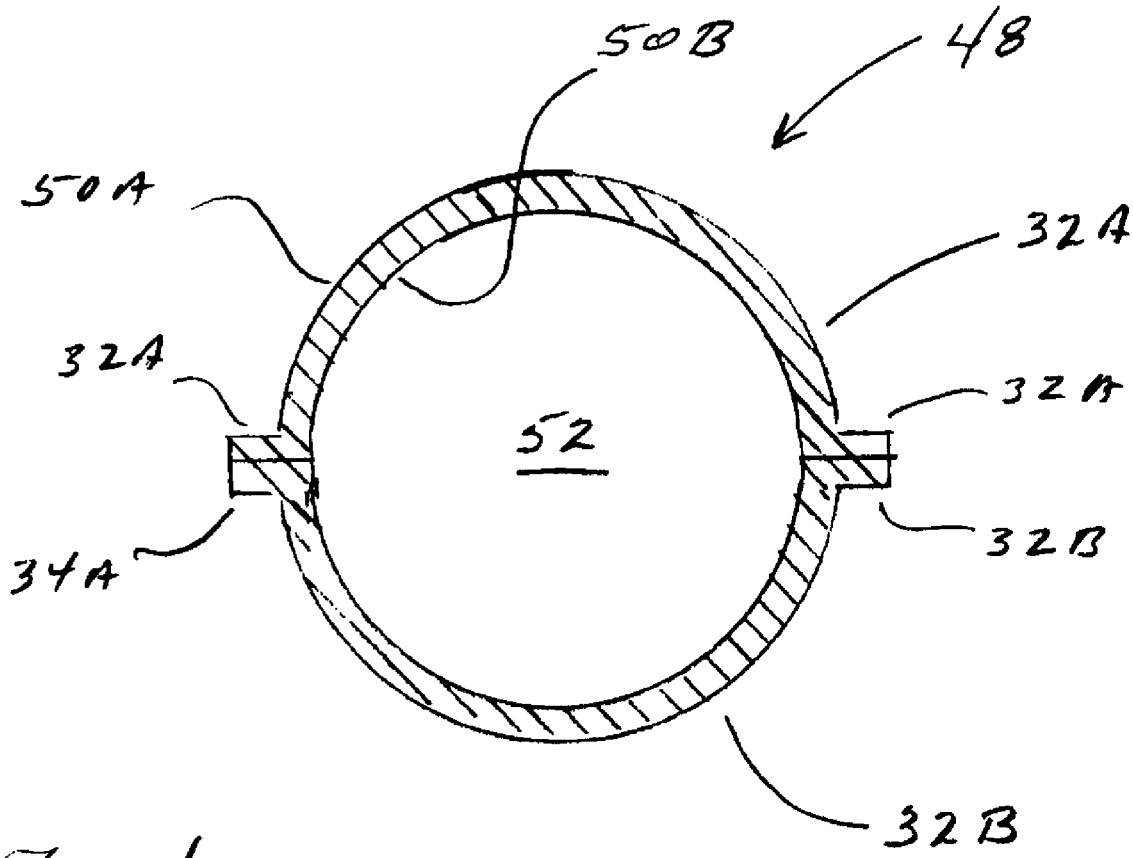
FIG. 4 is a cross-section of a tunnel section of an embodiment of a water slide.

With reference to FIG. 4, the covered portion of the slide 14 and the cover 20 define a tunnel 48 that has an external surface 50A and an internal surface 50B. An interior space 52 is defined by the interior surface 50B of the tunnel 48. At least a portion of the interior space 52 is relatively dark or totally dark.

Figures 5A, 5B, 5C:
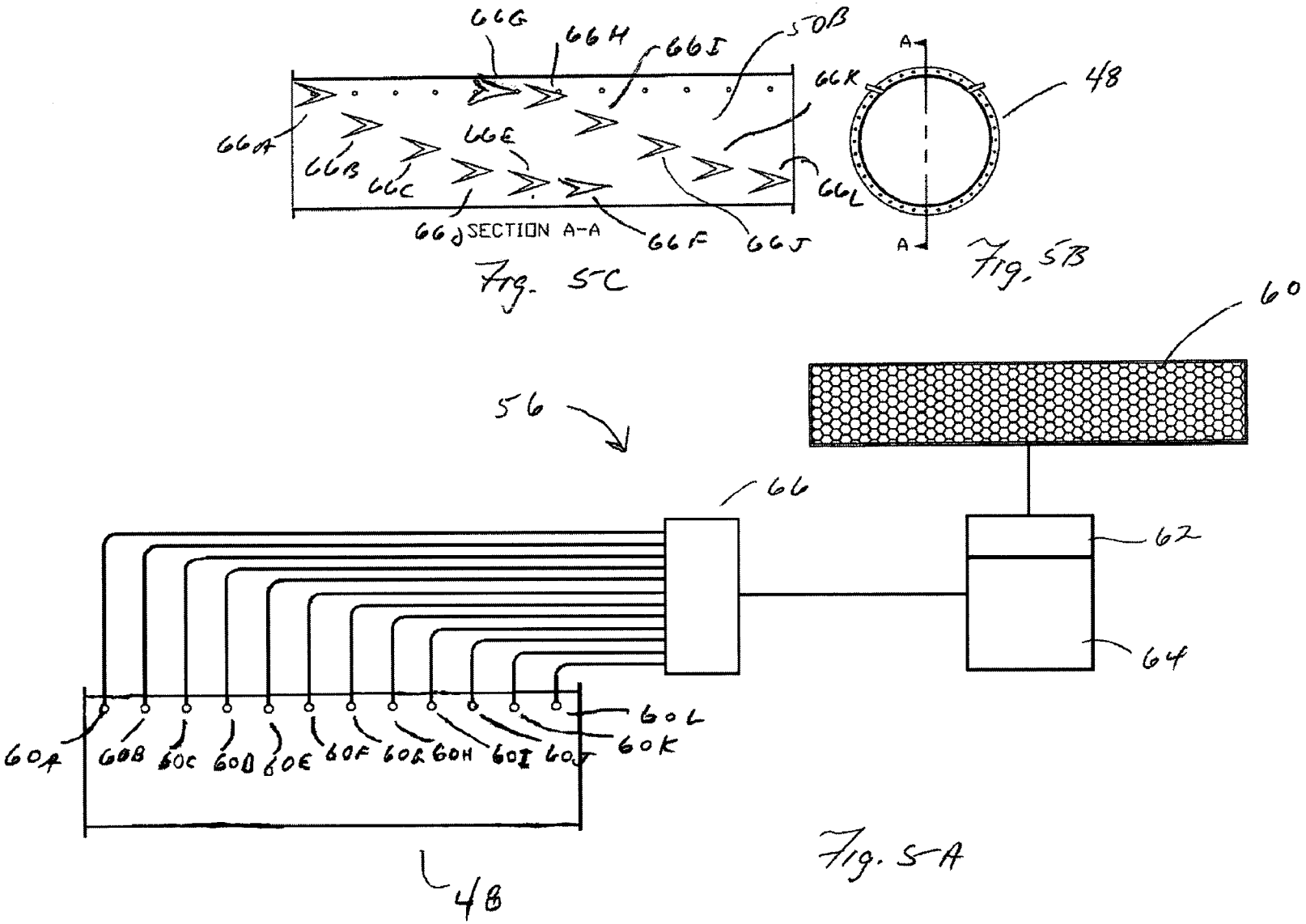
FIG. 5A is a block diagram of a lighting effect for a tunnel or portion of a tunnel associated with a water slide.
FIG. 5B is an end view of the tunnel or portion of a tunnel associated with a water slide and that is illustrated in FIG. 5A.
FIG. 5C is a longitudinal cross-section of the tunnel or portion of a tunnel associated with a water slide and that is illustrated in FIG. 5A.

With reference to FIGS. 5A-5C, an embodiment of a lighting effect 56 for use with a tunnel or portion of the tunnel 48 of a water slide is discussed. The lighting effect 56 is comprised of: (a) a plurality of lighting devices 60A-60L that are each capable of producing ultra-violet light, which is substantially invisible to most humans, (b) a solar panel 60, (c) a solar panel controller 62, (d) a battery bank 64, (e) a chaser circuit 66, and (f) a plurality of reactive elements 68A-68L each located adjacent to the interior surface 50B of the tunnel 48 and that each produce visible light in response to the ultraviolet light produced by a corresponding one of the lighting devices 60A-60L. The lighting devices each utilize a low voltage, low current draw, solid state light emitting diode (LED) to produce the ultraviolet light. Other lights that produce ultraviolet light are also feasible. It is also possible to use lights that produce infrared or IR light, which is also substantially invisible to most humans. The solar panel 60 can be implemented with the BP 350 produced by BP Solar; the solar controller 62 can be implemented with the SBC-6112 produced by Power Stream; and the chaser circuit 66 can be implemented with the Br-miniBrick8 produced by Gilderfluke & Co. Other solar panels, solar panel controllers, and controller/chaser circuits are available and can be adapted to create a lighting effect within a tunnel associated with a water slide. Other solar panel controllers are available or can be designed. The reactive elements, while shown as having chevron shapes to provide a user passing through the tunnel with a warning of an upcoming turn, can be of any desired shape and serve other purposes. For instance, the reactive elements can be used for aesthetic or entertainment purposes. The reactive elements can be implemented using fluorescent films that fluoresce under ultraviolet light, such as Oracal's fluorescent premium cast film. Such films either incorporate an adhesive that is used to attach the film to a surface or an adhesive is applied to the film for use in attaching the film to a surface. As an alternative to using films that fluoresce, fluorescent paint can be utilized. In cases in which a reactive element employs fluorescent paint, a clear coat that passes the invisible light is applied over the paint. Reactive elements are also available that fluoresce or otherwise react to produce visible light in response to infrared light. Further, reactive elements are available that produce different colors within the visible spectrum.

In operation, the solar panel 60 converts sunlight into an electrical current. The solar panel controller 62 processes the electrical current produced by solar panel 60 so that the current and related voltage are appropriate for recharging the battery or batteries in the battery bank 64. The battery bank 64 provides electrical power to the chaser circuit 66 that, in turn, provides electrical power to each of the lighting devices 60A-60L. The chaser circuit 66 is capable of: (a) modulating or sequencing the electrical power provided to each of the lighting devices 60A-60L and (b) synchronizing the application of power to the lighting devices 60A-60L. For example, the chaser circuit is capable of providing electrical power to each of the lighting devices 60A-60L for a predetermined period of time that does not overlap with the period of time during which power is provided to any other of the lighting devices 60A-60L and applying the power to the lighting devices 60A-60L in order, i.e., applying power to lighting device 60A for a first period of time, then applying power to lighting device 60B for a second period of time that does not overlap with the first period of time, then applying power to lighting device 60C for a third period of time that does not overlap with the first and second periods of time, and so on. As such, the chaser circuit 66 is capable of being used to create any number of different "light shows" within the tunnel 48. Each of the reactive elements 66A-66L respond to the invisible light produced by the corresponding one of the lighting devices 60A-60L by producing visible light. Further, each of the reactive elements 66A-66L produces visible light substantially in accordance with the manner in which the chaser circuit 66 is causing electrical power to be applied to the lighting devices 60A-60L. It should be appreciated that a chaser circuit that provides switching/modulating and sequencing capability can be implemented using discrete electrical/electronic elements, one or more integrated circuits, or combinations of discrete electrical/electronic elements and one or more integrated circuits. Further, such a chaser circuit can be implemented such that its operation is fixed or programmable.

Figure 6:
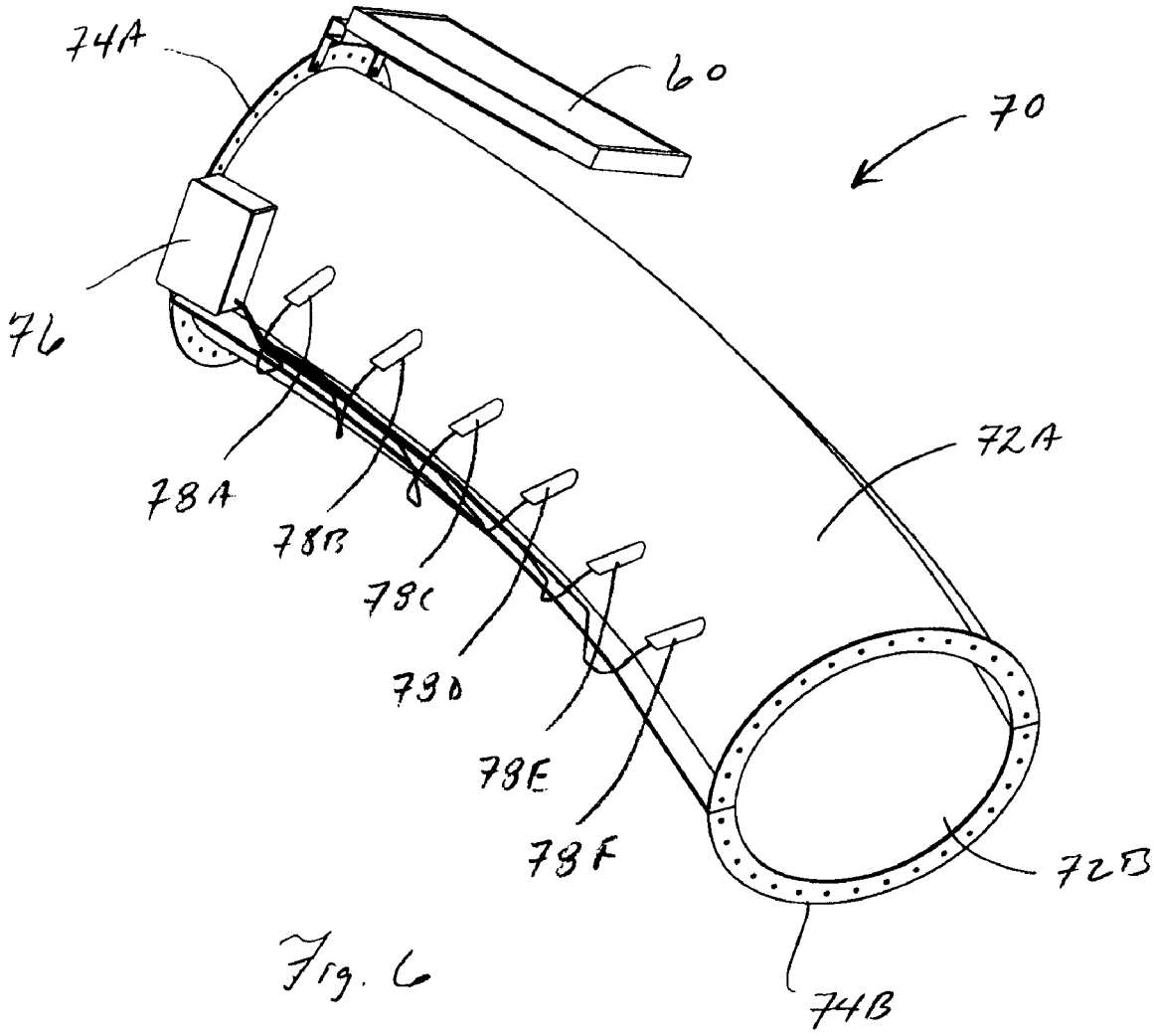
FIG. 6 illustrates a curved, tunnel section of a water slide with a lighting effect.

FIG. 6 illustrates a curved, tunnel section 70 with an embodiment of the lighting effect 56. The curved, tunnel section 70 has a top portion 72A, a bottom portion 72B, a first end flange 74A, and a second end flange 74B. The solar panel 60 is mounted to first end flange 74A. It should be appreciated that the solar panel 60 can be mounted at other locations associated with the water slide. A waterproof box 76 that stores the solar panel controller 62, battery bank 64, and the chaser circuit 66 is also mounted to the first end flange 74A. Other mounting locations for the waterproof box 76 are feasible. As an alternative to the waterproof box 76, two or more waterproof boxes can be provided that each house one or more of the solar panel controller 62, battery bank, and chaser circuit 66 if needed or desired for a particular application. In this case, the curved, tunnel section 70 utilizes lighting devices 78A-78F that are each electrically connected to the chaser circuit 66 housed within the waterproof box 76 via low voltage power lines, e.g., 12 V lines. Each of the lighting devices 78A-78F is operatively connected to the top portion 72A at a location that is associated with the cover 20, as opposed to the slide 14.

Figure 7:
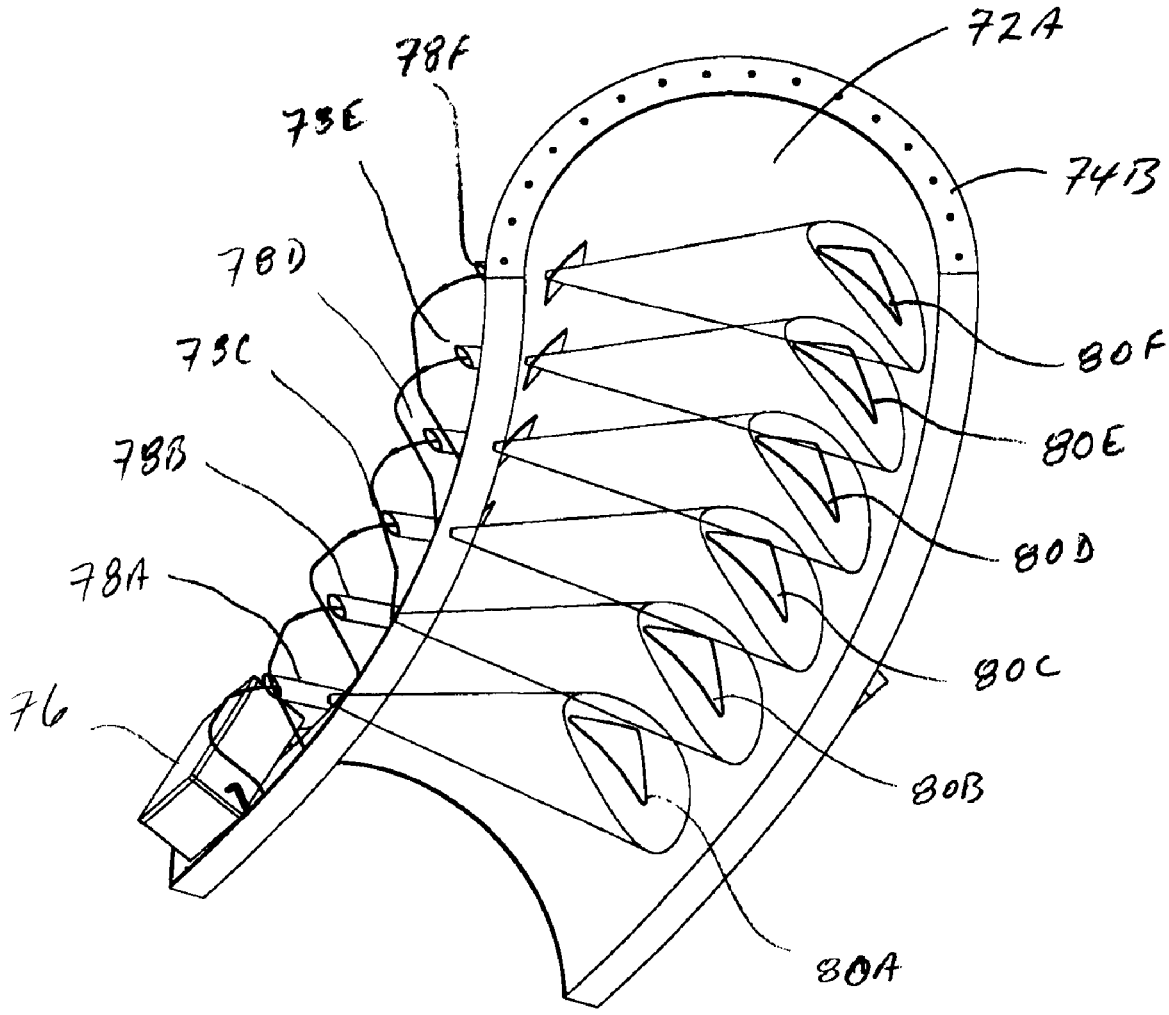
FIG. 7 illustrates the interior of the top portion of the curved, tunnel section illustrated in FIG. 6.

FIG. 7 illustrates the top portion 72A of the curved, tunnel section 70. Located adjacent to the interior surface of the top portion 72A are reactive elements 80A-80F. The reactive elements 80A-80F are located to receive the beams of ultraviolet light produced by the corresponding lighting device 78A-78F. It should be appreciated that the lighting devices 78A-78F and reactive device 80A-80F need not be positioned as shown in FIGS. 6 and 7. If needed, each of the lighting devices 78A-78F can be located at any position associated with the cover 20. It should also be appreciated that the ability to position lighting devices at positions associated with the cover 20 or portion of the cover associated with a curved tunnel section is also applicable to tunnel sections that are straight and both straight and curved. Further, it should also be appreciated that any number of lighting devices can be utilized. While it is possible to position a lighting device at a position associated with the slide 14, the possibility of water that is running down the slide leaking into the lighting device must be addressed. If two or more lighting devices are used in conjunction with two or more reactive elements, the chasing circuit 66 can sequence the application of power to the lighting devices in a desired manner and, as a result, the production of visible light by the reactive elements. Each of the reactive elements 80A-80F can be positioned at any location adjacent to the interior surface of the curved, tunnel section 70. As such, in the case of reactive elements that produce visible image that warn a user of a change in direction, the reactive elements can be positioned to give a warning of a left, right, upward, or downward change in direction of the slide. The reactive elements can be adhered to the interior surface of the tunnel section or be embedded within the tunnel section. In this regard, a clear gel coat is typically applied over a reactive device to protect the reactive device. It should be appreciated t that the ability to position reactive elements at any location adjacent to the interior surface of a curved, tunnel section is also applicable to straight and both straight and curved tunnel sections. Further, it should also be appreciated that any number of reactive elements can be utilized. Further, one-to-one correspondence between lighting devices and reactive elements is not required.

Figure 8:
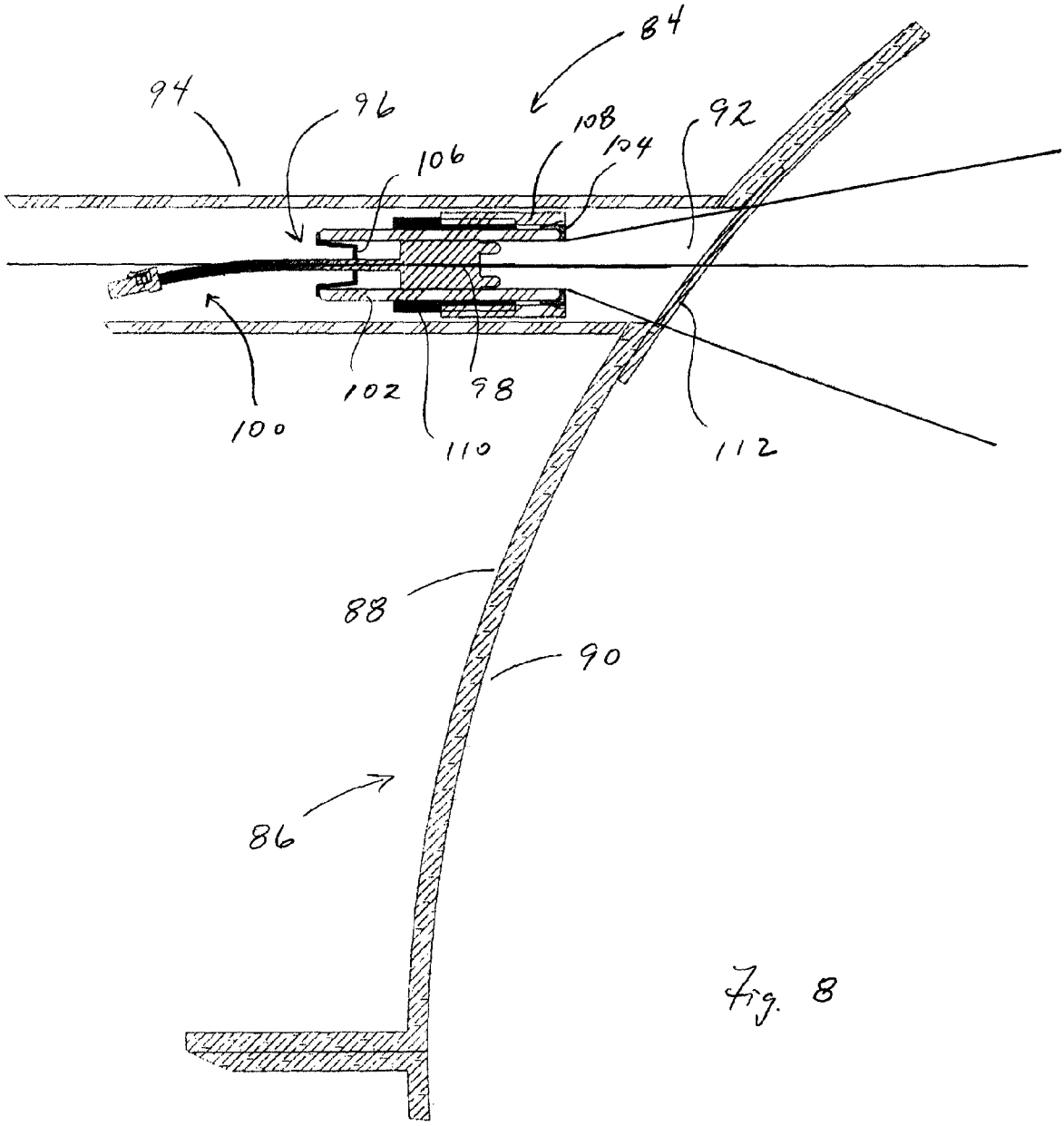
FIG. 8 is a cross-sectional illustration of a lighting device for producing ultraviolet light that is projected into the curved, tunnel section illustrated in FIG. 6 and the attachment of the lighting device to the curved, tunnel section.

FIG. 8 is a cross-sectional view of a lighting device 84 and a portion of a tunnel section 86 to which the lighting device 84 is attached. The portion of the tunnel section 86 has an exterior surface 88 and an interior surface 90. A hole 92 through which ultraviolet light produced by the lighting device 84 can pass extends between the exterior surface 88 and the interior surface 90. The lighting device 84 is comprised of an outer tube 94 that is epoxy bonded or otherwise attached to the exterior surface 88 of the portion of the tunnel section 86. Housed within the outer tube 94 is an LED assembly 96 that is capable of producing ultraviolet light. Alternatively, an LED assembly that is capable of producing infrared light can be used. The assembly 96 comprises an LED 98, an electrical connector 100 that is used to establish an electrical connection between the LED 98 and the chaser circuit, a tube 102 for holding the LED 98, a threaded cap 104 attached to one end of the tube 102, and a strain relief 106 for supporting the connector 100. Also housed within the outer tube 94 is a female coupling 108 that is attached to the outer tube 94 and is threaded so as to engage the threaded cap 104 that is attached to the tube 102. A male reducing fitting 110 is located between the tube 102 and the female coupling 108 to support the tube 102. A clear vinyl overcoat 112 covers the hole 92 to prevent water from coming into contact with the LED 98. After the overcoat 112 is removed, the threaded cap 104 is accessible from the interior of the tunnel and can be rotated so as to disconnect the LED assembly 96 from the female coupling 108, thereby allowing the LED assembly 96 to be removed and replaced. It should be appreciated that other lighting structures that are capable of providing invisible light that passes through at least a portion of a hole established in a tunnel section of an amusement slide are feasible. Further, it should also be appreciated that a single hole can be established in a portion of the tunnel that accommodates a fixture that holds two or more lighting devices, thereby avoiding the need to establish a hole for each light device. Such a fixture is capable of being adapted to allow adjustment of the direction in which a lighting device casts its light.

Also provided is a method for retrofitting an existing amusement slide, such as water slide, that has a tunnel with a lighting effect that utilizes invisible light to produce visible light within the tunnel. The method comprises locating the tunnel portion of the amusement slide and installing a lighting effect that utilizes invisible light to produce visible light within the interior space defined by the tunnel. The lighting effect includes a lighting device for producing invisible light and a reactive device that, in response to invisible light, produces visible light.

In one embodiment, the installation involves removing at least a portion of the tunnel from the remainder of the amusement slide. For example, with reference to FIG. 2, the top portion 32A of the straight, tunnel section 28 can be removed. After the portion of the tunnel has been removed, a substitute tunnel portion that is adapted to accommodate the lighting effect replaces the removed portion. For example, after the top portion 32A of the straight, tunnel section 28 has been removed, a substitute top portion that is adapted to accommodate the lighting effect is put in place. In one embodiment, one or more lighting devices, each capable of producing ultraviolet light or infrared light, and one or more reactive elements are attached to the substitute portion prior to putting the substitute portion in place in the amusement slide. In many cases, this can be done while allowing the amusement slide to continue to operate. The one or more lighting devices can each be attached to, or positioned adjacent to, the exterior surface of the substitute portion and one or more holes established in the substitute tunnel portion to accommodate the one or more lighting devices or the ultraviolet light produced by the one or more devices. Alternatively, one or more lighting devices can be attached to, or positioned adjacent to, the interior surface of the substitute tunnel portion. If appropriate or desirable, the lighting devices and/or reactive elements can be added after the substitute tunnel portion is in place. In addition, when a reactive element is going to be associated with a portion of the tunnel that is not being removed, the reactive element can be added to the tunnel at any time. Generally, however, such a reactive element is added after the relevant light device is in place. Further, if conventional grid power is not going to be utilized, a solar panel and solar panel controller can also be attached to the substitute tunnel portion prior to putting the substitute tunnel portion in place in the amusement slide. A chaser circuit, if desired, can also be attached to the substitute portion prior to placing the substitute tunnel portion.

As an alternative to replacing a removed portion of the tunnel with a substitute tunnel portion, the removed tunnel portion is adapted to accommodate the lighting effect and then put back in place in the amusement slide. In one embodiment, one or more lighting devices, each capable of producing ultraviolet light or infrared light, and one or more reactive elements are attached to, or positioned adjacent to, the removed portion prior to putting the removed portion back in place. The one or more lighting devices can each be attached to, or positioned adjacent to, the exterior surface of the removed portion and one or more holes established in the removed tunnel portion to accommodate the one or more lighting devices or the ultraviolet light produced by the one or more lighting devices. Alternatively, one or more lighting devices can be attached to the interior surface of the removed tunnel portion. If appropriate or desirable, the lighting devices and/or reactive elements can be added after the removed tunnel portion is put back in place. In addition, when a reactive element is going to be associated with a portion of the tunnel that is not being removed, the reactive element can be added to the tunnel at any time. Generally, however, such a reactive element is added after the relevant light device is in place. In situations in which the lighting devices are not to be provided with conventional grid power, a solar panel and solar panel controller are attached to the removed portion prior to putting the removed portion back in place. Further, if desired, a chaser circuit can also be attached to the removed portion prior to returning the removed portion to its place in the amusement slide.

An alternative to removing a portion of the tunnel is to associate the one or more lighting devices and one or more reactive elements with the tunnel portion of the amusement slide without removing the tunnel portion. The one or more lighting device can be attached to, or positioned adjacent to, either the exterior surface or the interior surface of the tunnel portion. If desired, a solar panel and solar controller can also be attached to, or positioned adjacent to the tunnel portion. Further, a chaser circuit can also be attached to, or positioned adjacent to the tunnel portion.

Although this disclosure describes illustrative embodiments of the invention in detail, it is to be understood that the invention is not limited to the precise embodiments described. The description and drawings are, accordingly, to be regarded in an illustrative sense, rather than a restrictive sense.

What is claimed is:

1. An amusement slide comprising:

a slide that extends from a first terminal end to a second terminal end, said first terminal end for receiving a user and said second terminal end for expelling a user;

a cover located adjacent to a portion of said slide;

said portion of said slide and said cover associated with said portion of said slide defining a tunnel with an exterior surface, an interior surface, and an interior space with at least a portion of the interior space being dark;

a hole extending between said exterior surface and said interior surface of said tunnel;

a lighting device for producing invisible light and that is located so that invisible light produced by said lighting device passes through at least a portion of said hole; and a reactive element, associated with said tunnel, for receiving said invisible light and, in response, producing visible light capable of being seen by a user passing through said tunnel.

2. An amusement slide, as claimed in claim 1, wherein:

said lighting device comprises a first lighting device and a second lighting device, each for producing invisible light.

3. An amusement slide, as claimed in claim 2, further comprising:

a controller capable of causing electrical power to be applied to said first lighting device for a first period of time and to said second lighting device for a second period of time that is different than said first period of time.

4. An amusement slide, as claimed in claim 1, further comprising:

a solar device for receiving sunlight and providing electrical energy for use by said lighting device.

5. An amusement slide, as claimed in claim 1, wherein:

said lighting device is capable of producing one of ultraviolet light and infrared light.

6. An amusement slide comprising:

a slide that extends from a first terminal end to a second terminal end, said first terminal end for receiving a user and said second terminal end for expelling a user;

a cover located adjacent to a portion of said slide;

said portion of said slide and said cover associated with said portion of said slide defining a tunnel with an exterior surface, an interior surface, and an interior space with at least a portion of the interior space being dark;

first and second lighting devices, each for providing invisible light;

a reactive element, associated with said tunnel, for receiving invisible light and, in response, producing visible light that is capable of being seen by a user passing through said tunnel; and a controller capable of causing electrical power to be applied to said first lighting device for a first period of time and to said second lighting device for a second period of time that is different than said first period of time.

7. An amusement slide, as claimed in claim 6, further comprising:

a hole extending between said exterior surface and said interior surface of said tunnel;

wherein at least one of said first and second lighting devices is located so that invisible light produced by said at least one of said first and second lighting devices passes through at least a portion of said hole and then into said interior space.

8. An amusement slide, as claimed in claim 6, further comprising:

a solar device for receiving sunlight and providing electrical energy for use by at least one of said first and second light producing devices.

9. An amusement slide, as claimed in claim 6, wherein:

at least one of said first and second lighting devices is capable of producing one of ultraviolet light and infrared light.

10. An amusement slide comprising:

slide that extends from a first terminal end to a second terminal end, said first terminal end for receiving a user and said second terminal end for expelling a user;

a cover located adjacent to a portion of said slide;

said portion of said slide and said cover associated with said portion of said slide defining a tunnel with an exterior surface, an interior surface, and an interior space with at least a portion of the interior space being dark;

a lighting device for providing invisible light;

a reactive element, associated with said tunnel, for receiving invisible light provided by said lighting device and, in response, producing visible light that is capable of being seen by a user passing through said tunnel; and a solar device for receiving sunlight and providing an electrical energy for use by said light producing device;

a hole extending between said exterior surface and said interior surface of said tunnel;

wherein said lighting device is located so that invisible light produced by said lighting device passes through at least a portion of said hole and then into said interior space.

11. An amusement slide comprising:

slide that extends from a first terminal end to a second terminal end, said first terminal end for receiving a user and said second terminal end for expelling a user;

a cover located adjacent to a portion of said slide;

said portion of said slide and said cover associated with said portion of said slide defining a tunnel with an exterior surface, an interior surface, and an interior space with at least a portion of the interior space being dark;

a lighting device for providing invisible light;

a reactive element, associated with said tunnel, for receiving invisible light provided by said lighting device and, in response, producing visible light that is capable of being seen by a user passing through said tunnel; and a solar device for receiving sunlight and providing an electrical energy for use by said light producing device;

said lighting device comprises a first lighting device and a second lighting device;

a controller capable of causing electrical current to be applied to said first lighting device for a first period of time and to said second lighting device for a second period of time that is different than said first period of time.

12. A method for providing a lighting effect to a pre-existing amusement slide comprised of: (a) a slide that extends from a first terminal end to a second terminal end, with the first terminal end for receiving a user and the second terminal end for expelling a user, (b) a cover located adjacent to a portion of said slide, (c) the covered portion of the slide and the cover defining a tunnel with an exterior surface and an interior surface, and (d) the tunnel, in the absence of artificially produced light, defining a relatively dark interior space, the method comprising:

locating said tunnel portion; and installing a lighting effect that utilizes invisible light to produce visible light within the interior space defined by the tunnel, said lighting effect comprising a lighting device for producing invisible light and a reactive element for, in response to invisible light, producing visible light;

said installing comprises:

removing at least a portion of said tunnel from the remainder of the amusement slide; and substituting a replacement portion for said at least a portion of said tunnel that was removed, said replacement portion being adapted to accommodate at least a portion of said lighting effect.

13. A method for providing a lighting effect to a pre-existing amusement slide comprised of: (a) a slide that extends from a first terminal end to a second terminal end, with the first terminal end for receiving a user and the second terminal end for expelling a user, (b) a cover located adjacent to a portion of said slide, (c) the covered portion of the slide and the cover defining a tunnel with an exterior surface and an interior surface, and (d) the tunnel, in the absence of artificially produced light, defining a relatively dark interior space, the method comprising:

locating said tunnel portion; and installing a lighting effect that utilizes invisible light to produce visible light within the interior space defined by the tunnel, said lighting effect comprising a lighting device for producing invisible light and a reactive element for, in response to invisible light, producing visible light;

said installing comprises:

removing at least a portion of said tunnel from the remainder of the amusement slide; and substituting a replacement portion for said at least a portion of said tunnel that was removed, said replacement portion being adapted to accommodate said lighting effect and comprising one of said lighting device and said reactive element.

14. A method for providing a lighting effect to a pre-existing amusement slide comprised of: (a) a slide that extends from a first terminal end to a second terminal end, with the first terminal end for receiving a user and the second terminal end for expelling a user, (b) a cover located adjacent to a portion of said slide, (c) the covered portion of the slide and the cover defining a tunnel with an exterior surface and an interior surface, and (d) the tunnel, in the absence of artificially produced light, defining a relatively dark interior space, the method comprising:

locating said tunnel portion; and installing a lighting effect that utilizes invisible light to produce visible light within the interior space defined by the tunnel, said lighting effect comprising a lighting device for producing invisible light and a reactive element for, in response to invisible light, producing visible light;

said installing comprises:

removing at least a portion of said tunnel from the remainder of the amusement slide; and substituting a replacement portion for said at least a portion of said tunnel that was removed, said replacement portion being adapted to accommodate said lighting effect, said replacement portion comprising said lighting device and said reactive element.

15. A method for providing a lighting effect to a pre-existing amusement slide comprised of: (a) a slide that extends from a first terminal end to a second terminal end, with the first terminal end for receiving a user and the second terminal end for expelling a user, (b) a cover located adjacent to a portion of said slide, (c) the covered portion of the slide and the cover defining a tunnel with an exterior surface and an interior surface, and (d) the tunnel, in the absence of artificially produced light, defining a relatively dark interior space, the method comprising:

locating said tunnel portion; and installing a lighting effect that utilizes invisible light to produce visible light within the interior space defined by the tunnel, said lighting effect comprising a lighting device for producing invisible light and a reactive element for, in response to invisible light, producing visible light;

said installing comprises:

removing at least a portion of said tunnel from the remainder of the amusement slide; and processing said at least a portion of said tunnel that has been removed to adapt said at least a portion of said tunnel to accommodate at least a portion of said lighting effect.

16. A method, as claimed in claim 15, wherein:

said processing comprises associating one of said lighting device and said reactive element with said at least a portion of said tunnel.

17. A method, as claimed in claim 15, wherein:

said processing comprises associating both of said lighting device and said reactive element with at least a portion of said tunnel.

* * * * *